United States Patent [19]

Brueck

[11] Patent Number: 4,926,588

[45] Date of Patent: May 22, 1990

[54] DEVICE FOR CENTERING OF OPTIC LENSES IN A MECHANICAL MOUNTING, IN PARTICULAR DURING EDGE CUTTING AND BEVELLING

[75] Inventor: Erhard Brueck, Heuchelheim, Fed. Rep. of Germany

[73] Assignee: Wilhelm Loh Wetzlar Optikmaschinen GmbH & Co. KG, Wetzler, Fed. Rep. of Germany

[21] Appl. No.: 289,922

[22] Filed: Dec. 23, 1988

[30] Foreign Application Priority Data

Dec. 24, 1987 [DE] Fed. Rep. of Germany ..... 374411

[51] Int. Cl.[5] ..... B24B 13/005; B24B 5/02; B23B 19/02; B23B 33/00

[52] U.S. Cl. ..... 51/217 T; 51/105 L G; 51/162; 51/217 L; 82/147; 82/151; 82/165; 82/903; 384/118

[58] Field of Search ..... 51/105 L G, 106 L G, 51/162, 217 L, 217 T, 237 R, 277; 82/122, 147, 151, 165, 170, 903; 384/1, 118

[56] References Cited

U.S. PATENT DOCUMENTS

| | | | |
|---|---|---|---|
| 2,508,009 | 5/1950 | Bonin | 51/217 T |
| 3,359,045 | 12/1967 | Hsu | 384/1 |
| 3,599,377 | 8/1971 | Dartnell | 51/277 |
| 3,732,757 | 5/1973 | Cottin | 82/147 |
| 3,750,344 | 8/1973 | Raphael | 51/105 L G |
| 4,434,581 | 3/1984 | Spriggs | 51/67 |
| 4,612,732 | 9/1986 | Delattre et al. | 51/105 L G |
| 4,612,736 | 9/1986 | Massard et al. | 51/105 L G |
| 4,809,466 | 3/1989 | Junker | 51/217 T |

FOREIGN PATENT DOCUMENTS

| | | |
|---|---|---|
| 1004516 | 8/1957 | Fed. Rep. of Germany . |
| 2148102 | 11/1978 | Fed. Rep. of Germany . |
| 3139873 | 4/1983 | Fed. Rep. of Germany . |

*Primary Examiner*—William Terrell

*Attorney, Agent, or Firm*—Flynn, Thiel, Boutell & Tanis

[57] ABSTRACT

For centering optic lenses in a mechanical mounting, in particular during an edge cutting and bevelling, the invention includes a device having a housing (10), a drive (M, R, 14/14', 16/16') for a lower centering spindle 18 and an upper centering spindle 18' with an interpositioning of a torque divider (50). The centering spindles are held in axial alignment by guiding and clamping bearings (22, 22') and carry clamping cups (20, 20'), between which clamping cups the lens (L), which is to be machined, can be clamped. A clamping device (24) is for this purpose connected parallel to a membrane piston (32), which assures a precise stepped moving of the lower centering spindle 18 in an axial direction (A) to the upper centering spindle (18'). A short-stroke piston (38) exists in each pressure cylinder 28, which short-stroke piston (38) is followed by a long-stroke piston (40) having a bore (42) extending therethrough. The lower centering spindle (18) is supported axially through the membrane piston (32) on the crossbar (26) and can be driven independently from the condition of the clamping device (24).

11 Claims, 4 Drawing Sheets

DEVICE FOR CENTERING OF OPTIC LENSES IN A MECHANICAL MOUNTING, IN PARTICULAR DURING EDGE CUTTING AND BEVELLING

CROSS REFERENCE TO RELATED APPLICATIONS

This application is related to my three copending applications filed concurrently herewith, each application having the same title, but separately identified as Attorney's Docket (1) Missling Case 213, (2) Missling Case 214 and (3) Missling Case 215.

1. Field of Invention

The present invention relates to a device for centering optic lenses in a mechanical mounting, in particular during edge cutting, and bevelling of the lens.

2. Background of the Invention

According to German Pat. No. 1 004 516, the lens is for this purpose clamped at high pressure between two cups, so that its position cannot change by itself. To center the lens, the clamping cups are vibrated by ultrasound during the clamping operation in order to convert the static friction between cup and lens into a lower sliding friction. However, this transition occurred sporadically, which often caused damage to the lens due to an undesired material removal.

Furthermore, an attempt has been made to drive the clamping cups during clamping of the lens in opposite directions of rotation. Here too a high risk exists that lens damage will occur, that is, cutting tracks in the form of rings cut into the surface of the lens can hardly be avoided.

German Auslegeschrift No. 21 48 102 suggests to arrange a piezoceramic case vibrator on the elevationally nonchangeable clamping cup, which case vibrator is electrically controlled by a threshold switch such that the clamping cup force drops off when reaching a pregiven pressure, which causes the vibration generator to be turned off. The piezovibrator is used at the same time to test the clamping pressure, to which the vibrational amplitude is regulated. Electronic instabilities are disadvantageous in this arrangement. Furthermore, the vibrator has a not insignificant sensitivity with respect to axial pressure. An initial stress is created during clamping due to the pressure load; a supporting of the vibrator is therefore problematic.

From German Offenlegungsschrift No. 31 39 873 a device is known in which the irregularities of a gear drive are utilized to produce relative movements between lens and clamping cup. A balanced differential is provided as a compensating device between the two parts of a two-part centering spindle and the drive shaft. A hydraulic clamping cylinder is provided for a pressure plate of the upper, axially movable spindle. Due to the high friction of the clamping spindle in its slide bearing, a precise regulating of the clamping pressure is, however, difficult to realize, so that this device can also only be utilized in a limited way.

The purpose of the invention is, while overcoming the disadvantages of the state of the art, to improve the centering and aligning of the lenses by means of clamping elements in a simple manner with damage to the lenses being avoided through a sensitive closing.

The centering spindles are constructed inventively as rigid, radially and axially directly supported shafts and are movable toward one another and away from one another by means of a pressure-medium-operated, in particular a hydraulic clamping device. Thus the spindle shafts themselves are used directly for the clearance-free radial and axial support. In addition, the spindle is supported by a membrane piston which operates parallel with respect to the clamping device The clamping spindles are first nearly closed, the lens, however, is not yet clamped between the clamping cups. The sensitive closing follows by means of the membrane piston, so that the lens can be aligned between the clamping cups such that damage to the lens is avoided. It is hereby simultaneously possible with the above-described means to change from static into a sliding friction. After the aligning operation there occurs then the actual clamping operation by means of the clamping device.

By turning off the pressure acting on short-stroke pistons, the cylinder housings move with the crossbar connecting them due to the pressure acting on long-stroke pistons axially in direction of the fixed spindle. Since the clamping force for machining of the lens exceeds by a multiple the pressure produced through the membrane piston for aligning the lens, the membrane piston sets down on the crossbar and the clamping force of the long-stroke pistons acts fully onto the shaft of the clamping spindle. The pressure acting on the long-stroke pistons is thereby adjusted so high that the force on the spindle shaft, which force is introduced through the crossbar, is as large as the clamping force needed at the lens plus the spring force, with which the axial support of the clamping spindle is adjusted. The preciseness of the axial guiding during the machining of the lens is controlled by the axial support of the fixed spindle.

Since modern grinding techniques assure the manufacture of shafts with a high exactness in diameter, circular concentricity and running, the necessary freedom from excessive clearance is achieved because of this surprisingly simple measure.

The construction of the clamping device allows the necessary clamping forces to be produced with a very neat and uncomplicated construction. Doubleacting pressure cylinders are used for this purpose, which are secured with their housing part on a crossbar and are anchored with their piston rods on the machine housing.

Each pressure cylinder has advantageously a short-stroke piston, after which is arranged a long-stroke piston having an axially extending bore therethrough. This permits in a simple manner a limiting of the approximate closing, so that then for the clamping operation only the short-stroke piston, which is used to limit the long-stroke piston, must yet be moved.

The crossbar axially supports through the membrane piston the lower end of the clamping spindle.

The axial movement of the clamping device can be controlled by pressure regulators, dynamometers and the like, which act on the pressure cylinders. This assures a good control of the clamping operation, so that a possible creation of waste during machining is reduced to a minimum.

It is provided that the drive elements are constructed such, and are arranged such, that the clamping device can be operated independent from the drive condition of the clamping spindle. Its axial movement can therefore be controlled precisely at every instant.

Important is furthermore the development according to which the drive elements can be smoothly driven through a split drive shaft. Cutting tracks, which so far have been hard or difficult to avoid, are thus not created.

BRIEF DESCRIPTION OF THE DRAWINGS

Further characteristics, details and advantages of the invention result from the wording of the claims and from the following description of one exemplary embodiment in connection with the drawings, in which:

DETAILED DESCRIPTION

Figure 1:
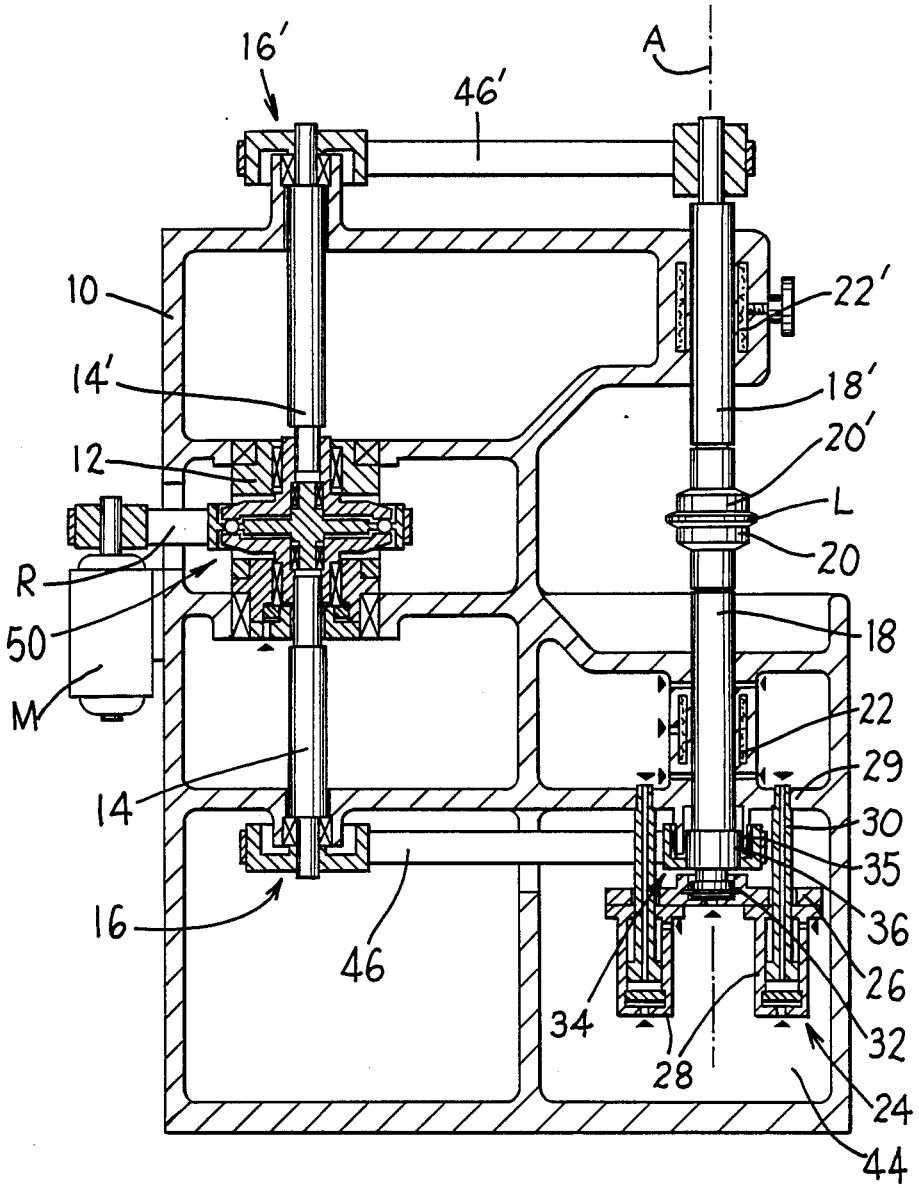
FIG. 1 is a complete axial cross-sectional view of a centering device.

The illustrated device has a housing 10 with a shaft bearing 12 for a split drive shaft 14, 14'. Same is drivingly connected to centering spindles 18, 18' through drive elements 16, 16'. The lower centering spindle 18 carries a lower clamping cup 20 and the upper centering spindle 18' carries an upper clamping cup 20'. A lens L can be clamped therebetween for the purpose of machining. The centering spindles 18, 18' are synchronously driven by a motor M through the drive elements 16, 16', the drive shafts 14, 14', a torque divider 50 and the belt drive R.

The housing 10 has a generally C-shape and has on projecting parts a lower guiding and clamping bearing 22' for the upper centering spindle 18'. The guiding and clamping bearings assure a fixed centering of the centering spindles during the machining operation. A clamping device 24 is stored in a chamber 44 and can be operated independently from the drive elements 16 in order to press the lower centering spindle 18 with the lens L resting on the lower clamping cup 20 axially against the axially aligned upper clamping cup 20'.

Figure 2:
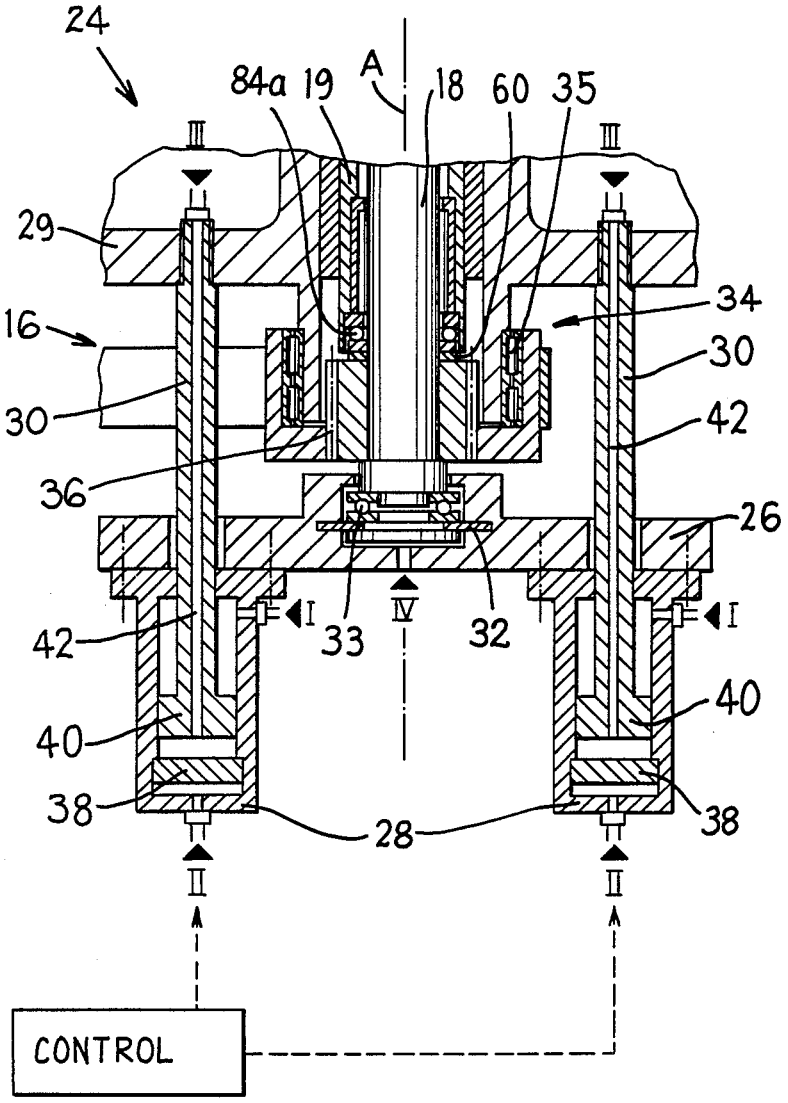
FIG. 2 is an enlargement of the clamping device illustrated at the bottom right of FIG. 1.
Figure 3:
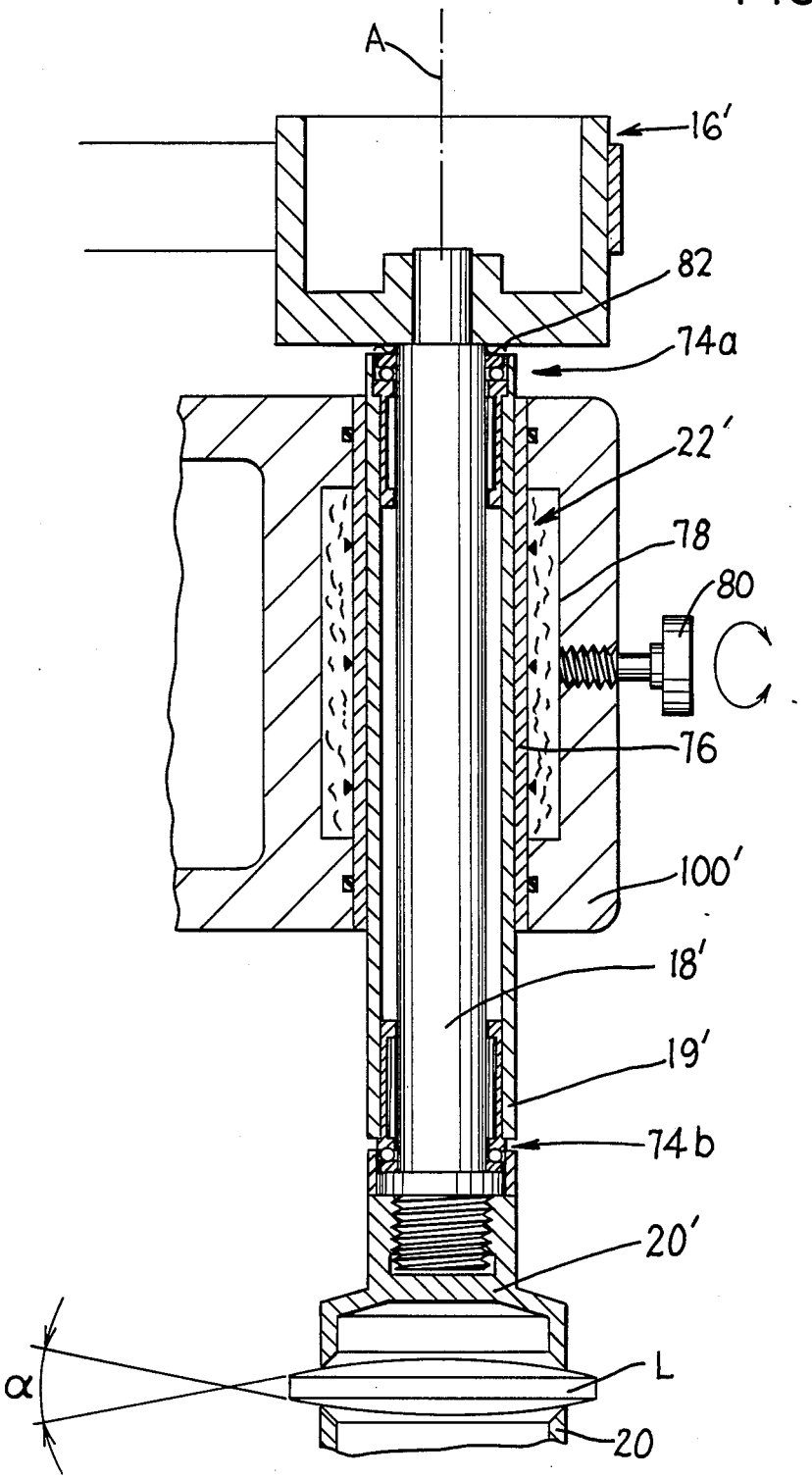
FIG. 3 is an enlarged axial cross-sectional view of an upper centering spindle guideway.
Figure 4:
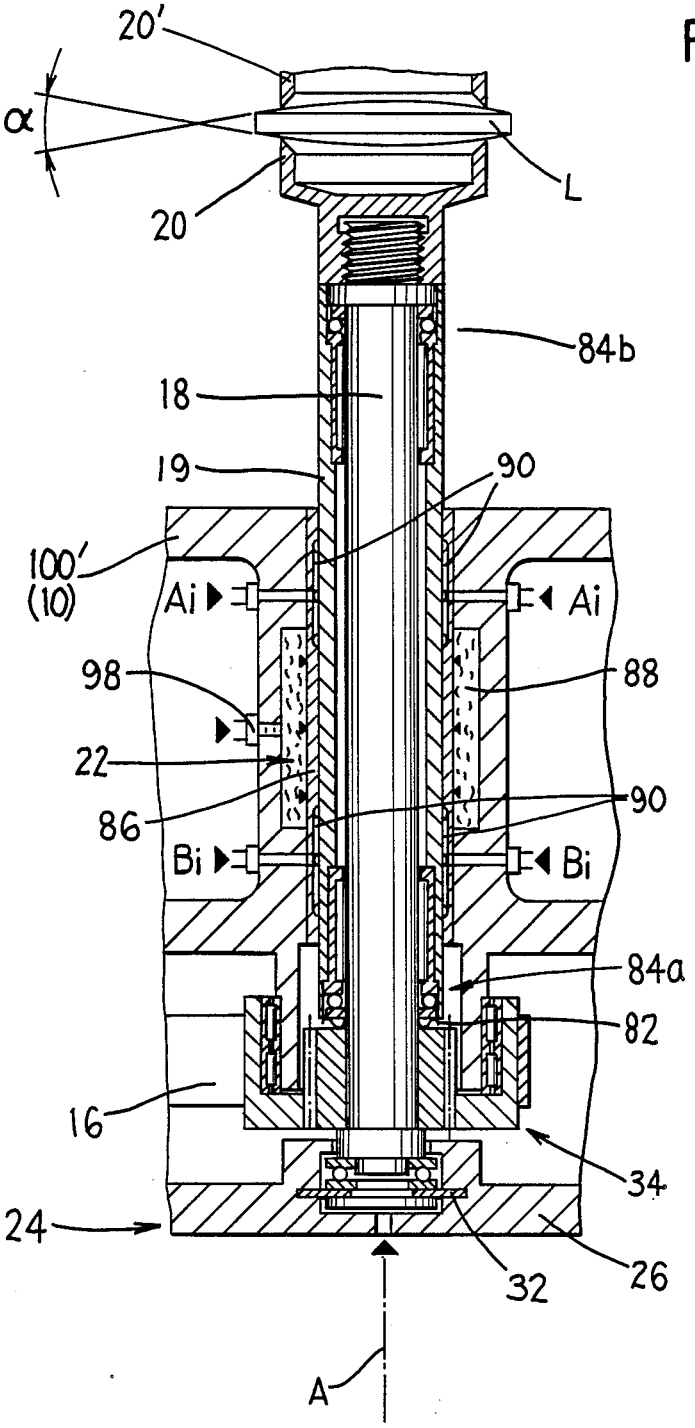
FIG. 4 is an enlarged axial cross-sectional view of a lower centering spindle guideway.

Details of this arrangement can be taken from FIG. 2. The clamping device 24 has a crossbar 26 which is constructed as a plate, on which plate the housing parts of two pressure cylinders 28 are fastened on both sides of the centering spindle axis A. The piston rods 30 of the pressure cylinders 28 extend freely through the crossbar plate 26; they are anchored on a housing plate 29 and have axially extending bores 42 therethrough in order to facilitate a double-acting pressure load (as indicated with arrow triangles).

A membrane piston 32 is centrally arranged in the crossbar 26 with respect to the lower centering spindle 18, the membrane piston 32 acting through a pressure bearing 33 axially onto the lower end of the lower centering spindle 18. The lower centering spindle 18 is axially and radially precisely supported in a drive gear 34 having a radial bearing 35 and a coupling piece 36. One of the drive elements 16, in particular a belt drive, engages the periphery of the drive gear 34. The spindle 18 has an outer sleeve 19 connected to the inner spindle shaft 18 through a support bearing **84*a*. This assures a particularly precise axial and radial support of the centering spindle 18**.

The pressure cylinders 28 have each a short-stroke piston 38 therein, after which follows a long-stroke piston 40 having a piston rod 30 thereon. If the pressure cylinders 28 are loaded simultaneously with the same pressure means at the pressure-means connections I and II, then the short-stroke pistons 38 move up to the upper stop in the cylinder housing and the cylinders 28 with the crossbar plate 26 and the centering spindle 18 (clamping spindle) mounted on the plate move in direction of the upper centering spindle 18' (fixed spindle). The upward movement is stopped as soon as the long-stroke piston 40 hits the already pressure-loaded short-stroke piston 38, which piston 38 has a larger active pressure surface. The fixed spindle 18' is adjusted in this position such that a gap of a few tenths of a millimeter exists between its clamping cup 20' and the lens L lying on the lower clamping cup 20.

If now in the crossbar 26 the cavity, which surrounds the pressure bearing 33, is placed through the connection IV under a precisely regulatable increased pressure, then the clamping spindle 18 is moved farther upwardly through the membrane piston 32. The lower centering spindle 18 is during this axial movement guided very precisely with extremely little friction in the air bearings 90. Since the membrane piston 32 also has a very low inner friction, the needed clamping force for an aligning of the lens L can be adjusted very precisely. Upon contact of the upper clamping cup 20' with the upper lens surface, shifting forces become active on the lens L, which shifting forces overcome the static friction of the lens L on the lower clamping cup 20. The lens L shifts therefore and is aligned according to the optic axis A.

If one now places the cavity 88 under a high pressure with a pressure medium through the connection 98, then a thin-wall guide sleeve 86 is centrally deformed toward the center to clamp the guide sleeve 19 with the spindle 18 in the adjusted position without changing the position of the axis.

Upon a turning off of the pressure acting onto the short-stroke pistons 38, the housings of the pressure cylinders 28 together with the crossbar plate 26 connecting them move axially in direction of the fixed spindle 18' due to the pressure which is still active on the long-stroke pistons 40.

The clamping force needed for machining of the lens L exceeds many times the pressure produced for aligning by means of the membrane piston 32. The membrane piston 32 is therefore placed onto the crossbar 26, so that the clamping force of the long-stroke pistons 40 acts fully onto the shaft of the clamping spindle 18. The pressure acting on the long-stroke pistons 40 is thereby adjusted so high that the force introduced through the crossbar 26 onto the lower centering spindle is as large as the clamping force needed at the lens L plus the force of a spring 82, with which spring the axial support of the clamping spindle 18 is adjusted. A support bearing **74*b* on the upper centering spindle 18'** assures an exact axial guiding during the lens machining.

All characteristics and advantages, which can be taken from the claims, the description and the drawings, including structural details, spacial arrangements and method steps, can be inventively important both by themselves and also in many different combinations.

The embodiments of the invention is which an exclusive property or privilege is claimed are defined as follows:

1. A device for centering optic lenses in a mechanical mounting for edge cutting and bevelling, comprising:

a housing;

a drive shaft and two coaxially aligned centering spindles rotatably supported in said housing, said centering spindles having a pair of respectively mutually adjacent ends, said mutually adjacent ends carrying clamping cups thereon for clamping a lens therebetween, one said centering spindle being axially movably supported in said housing, the other said centering spindle being axially adjustably arranged in said housing, said centering spindles being constructed as rigid, radially and axially supported shafts;

drive elements drivingly connected between said drive shaft and said centering spindles, and motor means drivingly connected to said drive shaft for rotating said drive shaft and said centering spindles; and pressurized fluid-actuated clamping means disposed in said housing for moving said centering spindles both axially toward and away from one another, said clamping means including means defining at least one pressure cylinder adapted to receive pressurized fluid and having an axis parallel to a direction of relative axial movement of said centering spindles, said clamping means further including a membrane piston which is engageable with an end of said one centering spindle opposite said clamping cups for urging said one centering spindle for axial movement in said housing relative to said pressure cylinder.

2. The device according to claim 1, wherein said clamping means includes a further said pressure cylinder, wherein said pressure cylinders are double-acting pressure cylinders and are arranged on substantially opposite sides of said one centering spindle, wherein said pressure cylinders are axially movably supported in said housing, and wherein said clamping means includes a crossbar which is carried for axial movement by said axially movable pressure cylinders.

3. The device according to claim 2, wherein said pressure cylinder defining means is secured to said crossbar, and wherein said clamping means includes pistons which are each axially slidably disposed in a respective said pressure cylinder, each said piston including a piston rod which extends out of the corresponding said pressure cylinder and is anchored on said housing.

4. The device according to claim 3, wherein each said piston includes means defining an axially extending bore therethrough, and wherein said clamping means includes further pistons respectively axially slidably disposed in each said pressure cylinder, said further pistons being short-stroke pistons, said first-mentioned pistons being long-stroke pistons.

5. The device according to claim 4, wherein said pressure cylinder defining means includes means defining an axially facing annular stop in each said pressure cylinder, said short-stroke pistons being engagable against respective said annular stops to urge said pressure cylinders for axial movement.

6. The device according to claim 2, wherein said crossbar is secured to said one centering spindle at said end thereof opposite said clamping cups.

7. The device according to claim 1, wherein said drive elements include a coupling piece fastened to said one centering spindle at said end thereof opposite said clamping cups, a drive gear, and radial bearings for rotatably supporting said drive gear on said housing, said coupling piece and said drive gear being drivingly connected but axially movable relative to one another.

8. The device according to claim 1, wherein said clamping means includes control means connected to said at least one pressure cylinder for regulating the fluid pressure therein.

9. The device according to claim 1, wherein said drive elements cooperate with said clamping means such that said centering spindles are axially movable toward and away from each other by said clamping means independently of the rotation of said centering spindles.

10. The device according to claim 1, wherein said drive shaft includes two coaxially aligned drive shaft parts, and wherein said drive elements are drivingly connected to respective said drive shaft parts.

11. The device according to claim 1, wherein said centering spindles are arranged vertically in said housing.

* * * * *